US005139072A

United States Patent [19]

Marocco

[11] Patent Number: 5,139,072

[45] Date of Patent: Aug. 18, 1992

[54] COUPLING AND TRANSMISSION MECHANISM FOR DRAPE OR BLIND ASSEMBLY

[76] Inventor: Norbert Marocco, 46 Pennycross Court, Woodbridge, Ontario, Canada, L4L 3M6

[21] Appl. No.: 733,652

[22] Filed: Jul. 22, 1991

Related U.S. Application Data

[63] Continuation-in-part of Ser. No. 475,734, Feb. 7, 1990.

[51] Int. Cl.[5] ..... E06B 9/26

[52] U.S. Cl. ..... 160/176.1; 160/178.1

[58] Field of Search ..... 160/177, 170, 168.1, 160/176.1, 178.1

[56] References Cited

U.S. PATENT DOCUMENTS

| | | | |
|---|---|---|---|
| 2,809,531 | 10/1957 | Moyer . | |
| 3,333,905 | 8/1967 | Hennequin | 160/177 X |
| 3,347,062 | 10/1967 | Schumann et al. . | |
| 3,425,479 | 2/1969 | Lorentzen et al. . | |
| 4,103,727 | 8/1978 | Spohr . | |
| 4,122,885 | 10/1978 | Marotto . | |
| 4,177,853 | 12/1979 | Anderson et al. | 160/168.1 |
| 4,257,470 | 3/1981 | Woodle . | |
| 4,267,875 | 5/1981 | Koks . | |
| 4,406,319 | 9/1983 | McNiel et al. . | |
| 4,531,563 | 7/1985 | Nilsson | 160/177 X |
| 4,621,673 | 11/1986 | Georgopoulos et al. . | |
| 4,627,673 | 11/1986 | Georgopoulos et al. | 160/176.1 X |
| 4,643,238 | 2/1987 | Tachikawa et al. | 160/177 X |
| 4,676,292 | 6/1987 | Valle et al. . | |
| 4,719,955 | 1/1988 | Tachikawa et al. . | |
| 4,875,516 | 10/1989 | Marocco | 160/177 X |

FOREIGN PATENT DOCUMENTS

| | | | |
|---|---|---|---|
| 2805469 | 8/1978 | Fed. Rep. of Germany | 160/177 |

*Primary Examiner*—Blair M. Johnson

[57] ABSTRACT

A drape or blind assembly having a headrail in which there is disposed a shaft, on rotation of which the position of the drapes or blind slats is adjusted, and a transmission mechanism which comprises a drive gear and a coupling adapted to be coupled to such a shaft so that rotation of the drive gear normally causes rotation of the shaft. If, however, the drive gear is rotated past a predetermined rotational position, a stop member generally provided on the coupling engages an abutment member to prevent further rotation of the shaft. To prevent damage to the mechanism in such a situation, the mechanism includes a recess defined by first drive surfaces and a resilient arm means having complementary second drive surfaces. On continued rotation of the drive gear after the stop member has engaged the abutment member, the resilient arm means flexes to permit relative rotation of the first and second drive surfaces. Bearings are provided in the headrail for rotatably supporting the shaft, and retaining it in position.

21 Claims, 4 Drawing Sheets

FIG. 1
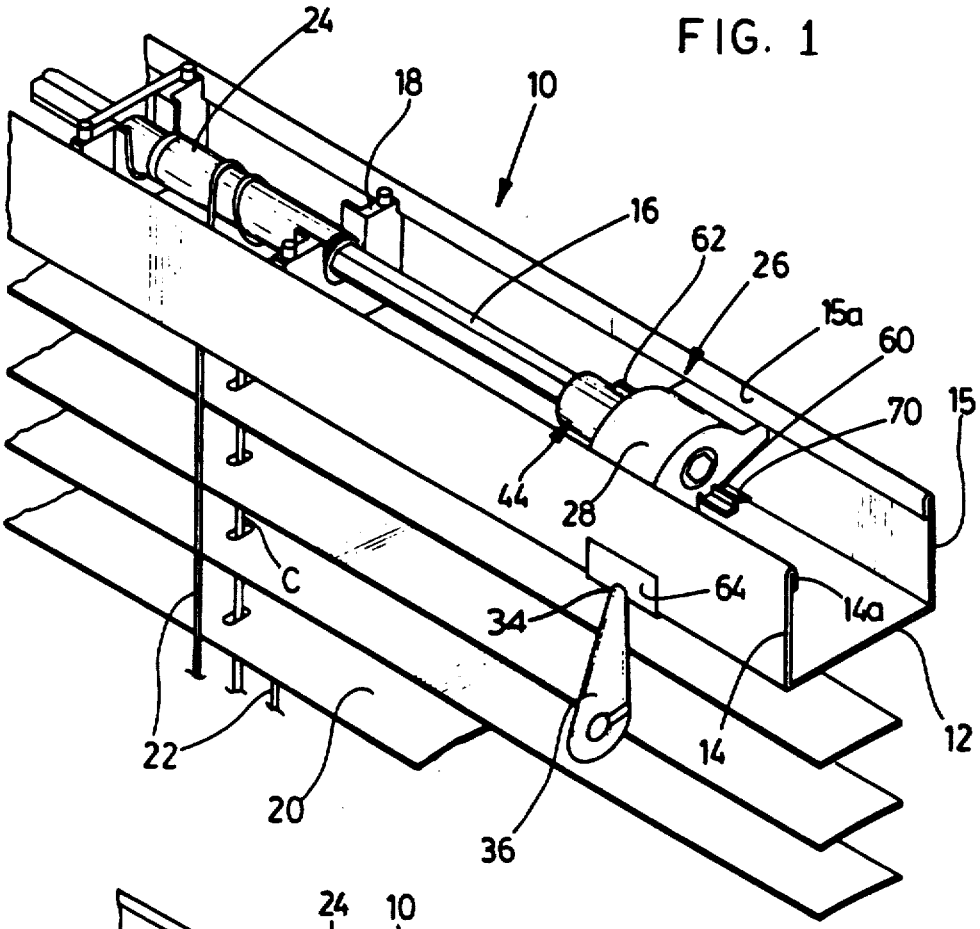
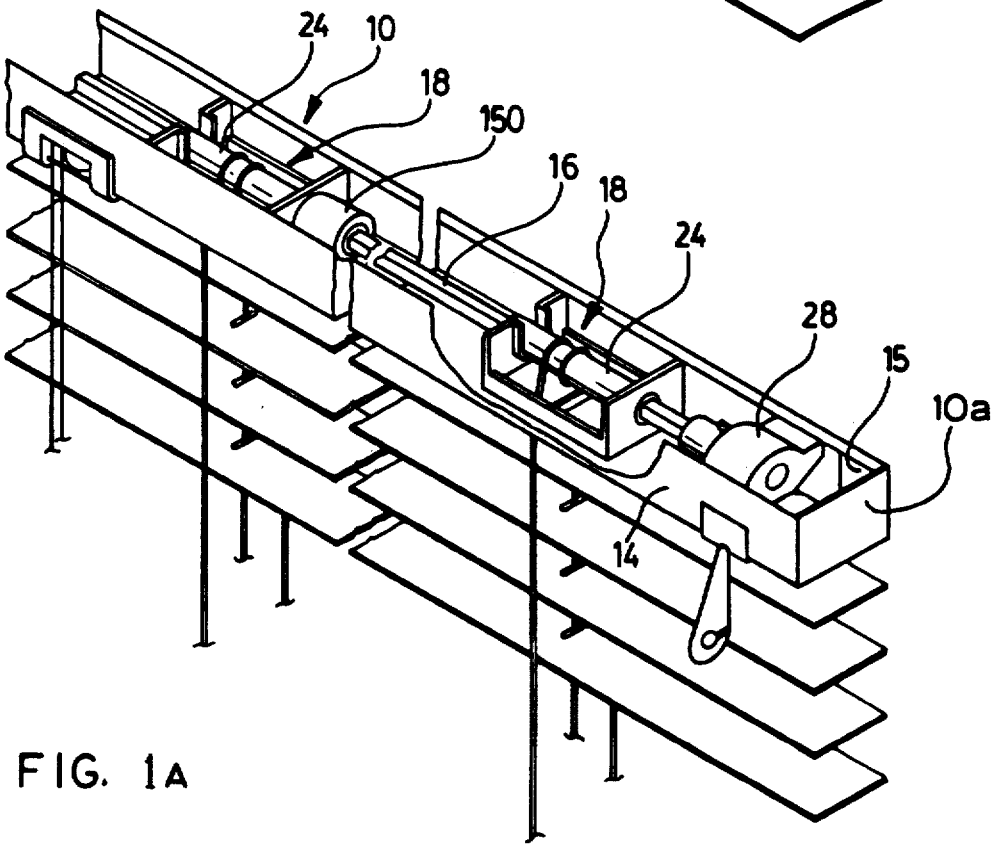
FIG. 1A

COUPLING AND TRANSMISSION MECHANISM FOR DRAPE OR BLIND ASSEMBLY

FIELD OF THE INVENTION

The invention relates drape and blind assemblies an to a coupling for use in transmission: mechanisms, and also to a novel form of bearing assembly and method of assembling such drapes and blinds using such bearing assemblies. This application is a continuation-in-part of U.S. patent application Ser. No. 475,734 filed Feb. 7, 1990 entitled Coupling and Transmission Mechanism for Drape or Blind Assembly.

BACKGROUND OF THE INVENTION

Venetian blinds are well known in which a so-called headrail or channel supports a horizontal shaft. The horizontal shaft carries the tapes or cords on which the slats of the venetian blind are supported. Rotation of the rod in one direction or the other will tilt the slats one way or the other, thus closing and opening the blind.

Operation of the control rod may be through a pulley and continuous chain, or may be by means of a worm and wheel, and a wand rotating the worm, so as to thereby rotate the shaft.

The shaft on which the tapes or cords are wound, can only be rotated a certain distance in either direction, and will then stop. If, however, excessive torque is applied to the shaft, the blind can be damaged.

Accordingly, it is desirable to incorporate a torque limiting device so that if the continuous chain or wand is rotated beyond the point at which the shaft must stop, the chain or wand will simply rotate, and the torque limiting device will prevent the rotation being transmitted to the shaft. Various different types of clutch devices have been proposed, in most cases being of considerable degrees of complexity requiring costly tooling, and time-consuming assembly. In addition, as the design of venetian blinds becomes further and further refined, the space available for incorporating such a torque limiting device becomes more and more restricted.

In many cases, where a worm and wheel drive is used, the axis of the wheel in the mechanism is offset with respect to the axis of the shaft. As a result, it is also necessary to incorporate some form of flexible coupling, to take into account the lack of alignment, and this further complicates the incorporation of a torque-limiting device.

In some drape or blind assemblies, a rotatable shaft is provided in the headrail for raising and lowering the drapes or blind slats. In such assemblies, it is also desirable to provide a transmission or clutch mechanism for limiting rotation of such shaft beyond certain limiting positions.

This invention provides a transmission mechanism for use in drape and blind assemblies of the type including a headrail having disposed therein a control shaft on rotation of which the positions of the drapes or blind slats may be adjusted and in which the transmission mechanism is operative to limit rotation of such a shaft while preventing accidental damage to the drive or transmission mechanisms if a person operates the drive mechanism in an attempt to move the shaft beyond such limiting positions.

This invention provides a novel coupling for use in such a transmission mechanism.

This invention also provides a novel form of bearing for supporting the shaft in the headrail.

The invention is not restricted solely to venetian blinds but is also of application to other forms of drape and blind assemblies. One design of such venetian blind assemblies is shown in U.S. Pat. No. 4,531,563.

The design disclosed in this patent involves the use of a headrail of channel shaped construction, having two edge flanges. The tilt rod was supported on two or more bearing assemblies. Each of the bearing assemblies consisted of generally U-shaped rectangular metal components which could be snap fitted in the headrail and secured in position by frictional engagement with edge flanges on the headrail.

In this design, however, it was necessary to provide additional rod retention components also of a generally inverted U-shaped sheet metal construction, which could be snap fitted into the headrail after the insertion of the tilt rod in the bearing assemblies, and then retaining the tilt rod in position in the bearing assemblies.

Thus each of the bearing assemblies consisted of two separate components. Each of the components had to be snap fitted into the blind headrail at separate times, requiring two distinct operations for the completion of each bearing assembly.

In addition, since the components illustrated in that patent were formed of sheet metal, their construction was relatively expensive. As a result that design, while having met with considerable commercial success in the past, is nevertheless relatively expensive in terms of the actual components themselves and is also relatively costly in terms of the manhours required for assembly.

In addition to these features of this earlier design, the tilt rod itself was retained at one end in a tilt control drive mechanism, of a type which is generally well known in the art, although different designs are provided by different manufacturers.

However, in order to retain the tilt rod in position in engagement with the drive assembly, it was necessary in this earlier design to provide a form of stop mechanism engaging the free end of the tilt rod remote from the gear drive, to retain the one end of the tilt rod in engagement with the tilt drive. This meant that yet another component again formed of sheet metal, had to be designed and manufactured and supplied and then assembled in order to provide a complete function blind.

A further design of tilt rod bearing for venetian blinds is illustrated in U.S. Pat. No. 4,333,510. In that form of bearing, the bearing assembly consisted of a one piece integral moulded structure. The structure incorporated two U-shaped bearings for the tilt rod. One of the U-shaped structures incorporation abutments to retain the tilt rod in position.

In that form of structure, the bearing assembly had lower leg portions adapted to extend through the lower central web of the headrail, and had tooth formations engaging either side of an opening in the lower web portion of the headrail.

In that form of bearing, openings were provided in the lower portion of the bearing structure for passage of the tilt elements and the suspension elements but without the provision of any antifriction bearing. As a result, extensive use would cause wear on the plastic around the openings.

A still further form of blind assembly is illustrated generally in U.S. Pat. No. 4,945,970 issued Aug. 7, 1990 entitled CORD LOCK UNIT FOR DRAPE OR BLIND ASSEMBLY.

However, no details of the bearing assembly are illustrated in that Patent.

It is, therefore, apparent that it is desirable to provide such a venetian blind assembly in which the tilt rod is supported in bearings of integral one piece moulded construction, which bearings both support the tilt rod and also retain it in the headrail, and in which the bearings are securely held relative to the headrail against movement, and in which the bearing assemblies incorporate antifriction means for passage of the flexible tilt elements and flexible support element.

Other objects of the invention will become apparent as the description herein proceeds.

BRIEF SUMMARY OF THE INVENTION

Broadly, the present invention provides a drape or blind assembly of the type including a headrail having drapes or blind slats suspended therefrom and having disposed therein a shaft on rotation of which the positions of the drapes or blind slats may be adjusted and which transmission mechanism comprises a housing adapted to be disposed in such a headrail, a drive member rotatably supported in the housing for rotation about a first axis, support means on the housing whereby it may be non-rotatably disposed in the headrail with the axis of such drive member aligned with the axis of the shaft within the headrail, a coupling coupled to the drive member and adapted to be coupled to the shaft for transmitting rotational movement of the drive member to such shaft, a stop member, and an abutment member adapted to engage the stop member on rotation of the coupling to a predetermined rotational position thereby then to prevent further rotation of that coupling, the transmission mechanism including a recess having internal first surfaces, and resilient arm means extending into said recess and having second surfaces complementary to the first surfaces and adapted normally to engage those first surfaces to transmit rotational movement therebetween and whereby, upon rotation of the shaft to such predetermined rotational position and engagement of the stop member with the abutment member, and if excessive torque is thereafter applied to said resilient arm means on continued rotation of the drive member, to cause said arm means to flex thereby in turn to permit one of said first and second drive surfaces to continue to rotate past the other of said first and second drive surfaces.

In such a transmission mechanism, the aforementioned recess can be provided in the drive member with the resilient arm means integrally formed with the coupling. Alternatively, the recess can be provided in the coupling with the resilient arm means integrally formed with the drive member.

Such resilient arm means can comprise a pair of mutually spaced apart arms separated by an axially extending slot whereby said arms will be flexed toward each other when sufficient torque is applied thereto but will spring apart from each other when such an excessive torque is no longer applied.

The stop member provided in such a transmission mechanism will generally be integrally formed with the coupling to project therefrom. The abutment member can be integrally formed with the housing to project therefrom or may be provided as a separate component adapted to be secured to the headrail of such a drape or blind assembly.

The coupling forming part of a transmission mechanism in accordance with this invention may usefully include an axial recess extending into the coupling for receiving the shaft of the drape or blind assembly.

One embodiment of a transmission mechanism in accordance with this invention also comprises a worm drive gear carried by a drive shaft rotatably supported in the housing, such worm drive gear engaging the drive member whereby rotation of the worm drive gear causes rotation of the drive member. In such an embodiment, the housing preferably comprises a boss portion adapted to extend through an opening in the headrail of the drape or blind assembly with the drive shaft extending through the boss portion.

As already indicated, the present invention also provides a novel coupling for use in a transmission mechanism in a drape or blind assembly of the type hereinbefore described. Such a coupling can be broadly defined as comprising a body adapted to be coupled to the shaft of the drape or blind assembly for co-rotation therewith and having integrally formed therewith resilient arm means having second surfaces complementary to the surfaces within a recess of a drive member forming part of such a transmission mechanism, and a stop member on that body and adapted, upon rotation of the coupling to a predetermined rotational position, to engage an abutment member so that if excessive torque is then applied to the resilient arm means by continued rotation of such drive member such torque causes the arm means to flex thereby in turn to permit the drive member to continue to rotate with the first surfaces rotating past such second surfaces without transmitting the torque to the shaft.

Such a coupling finds use in the manufacture of drape and blind assemblies incorporating existing forms of transmission mechanisms. For example, such a coupling can be used with a transmission mechanism in which the end of the shaft is normally received in an axial recess in the drive member or gear of the transmission mechanism. It will be understood that the housing of such an existing transmission mechanism will not be provided with an abutment member for engaging the stop member on the coupling. This can, however, be resolved by providing a separate abutment member adapted to be secured in an appropriate position on the headrail of the assembly.

Generally, a coupling as provided by this invention will be provided in its body member with an acircular axial recess adapted to receive the end of the shaft of such a drape or blind assembly for transmitting rotational movement from the coupling to such a shaft.

In another embodiment of the invention, the invention broadly comprises a venetian blind assembly in turn comprising a headrail channel member of generally three sided U-shaped channel construction, and defining edge retaining formations on the two free edges thereof, control rod means in said headrail channel, and drive means for rotating said tilt rod means, said tilt rod means being axially moveable relative to said drive means, a plurality of bearing means each of said bearing means being of integral one piece construction, each said bearing means defining bearing recess means for receiving said tilt rod, and rod retaining means for retaining said tilt rod in said bearing recess means, formed as a single integral unit, and, means for securing flexible tilt control elements to said tilt rod, and means for guiding flexible slat support elements, for movement within said headrail.

In a preferred embodiment of the bearing assembly, the bearing comprises an integral one piece thermoplastic structure having two upstanding bearing wall portions, and a junction portion extending between them. A generally upwardly open U-shaped bearing is formed in one of the bearing walls, and a bearing through-opening is formed in the other of the bearing walls, having a bridge portion extending thereacross. The bridge portion is adapted to retain the shaft of the drape or blind assembly in position.

The bearing assembly is also preferably provided with shoulders, adapted to make a snap fit within the two side edges of the headrail, so as to retain the bearing assembly in position.

In order to facilitate insertion the bearing assembly is further preferably provided with generally wedge shaped side surfaces, so that as it is forced downwardly into the headrail, it progressively spreads the walls of the headrail apart.

In a further preferred form of the bearing, openings are provided through the junction wall of the bearing assembly, for passage of the cords and tapes and the like, and roller bearing means are provided supported adjacent to such opening, to provide antifriction guides for the cords or tapes so as to prolong the life of the drape or blind assembly.

The invention further comprises such a venetian blind assembly wherein the bearing means comprises opening means for said flexible support elements, bearing support means on either side of said opening means, and, antifriction means supported in said bearing support means and extending from side to side of said opening means, whereby to guide said flexible support elements from said bearing means through said opening means.

The invention further comprises such a venetian blind assembly and further including a clamp member inter-engageable with and rotatable with said tilt rod, whereby to lock the same against axial movement relative to said drive means.

The invention further comprises such a venetian blind assembly and wherein said walls of said U-shaped channel of said headrail are resiliently moveable relative to one another whereby to spread apart and to close, and including wedging surfaces on said bearing means, whereby said bearing means may be press fitted downwardly between said walls of said U-shaped rail, spreading the same progressively apart, and including abutment means formed on said bearing means, for inter-engagement with said retention means on said free edges of said wall means.

Other features of the invention and the advantages presented thereby will become apparent as the description herein proceeds.

The various features of novelty which characterize the invention are pointed out with more particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWINGS

FIG. 1 is a fragmentary perspective illustration of a venetian blind assembly showing one embodiment of a transmission mechanism in accordance with this invention in position therein;

FIG. 1A is a fragmentary perspective illustration of a venetian blind assembly showing a similar embodiment to FIG. 1, and illustrating two bearing assemblies spaced apart along the headrail;

DESCRIPTION OF THE PREFERRED EMBODIMENTS

Figure 2:
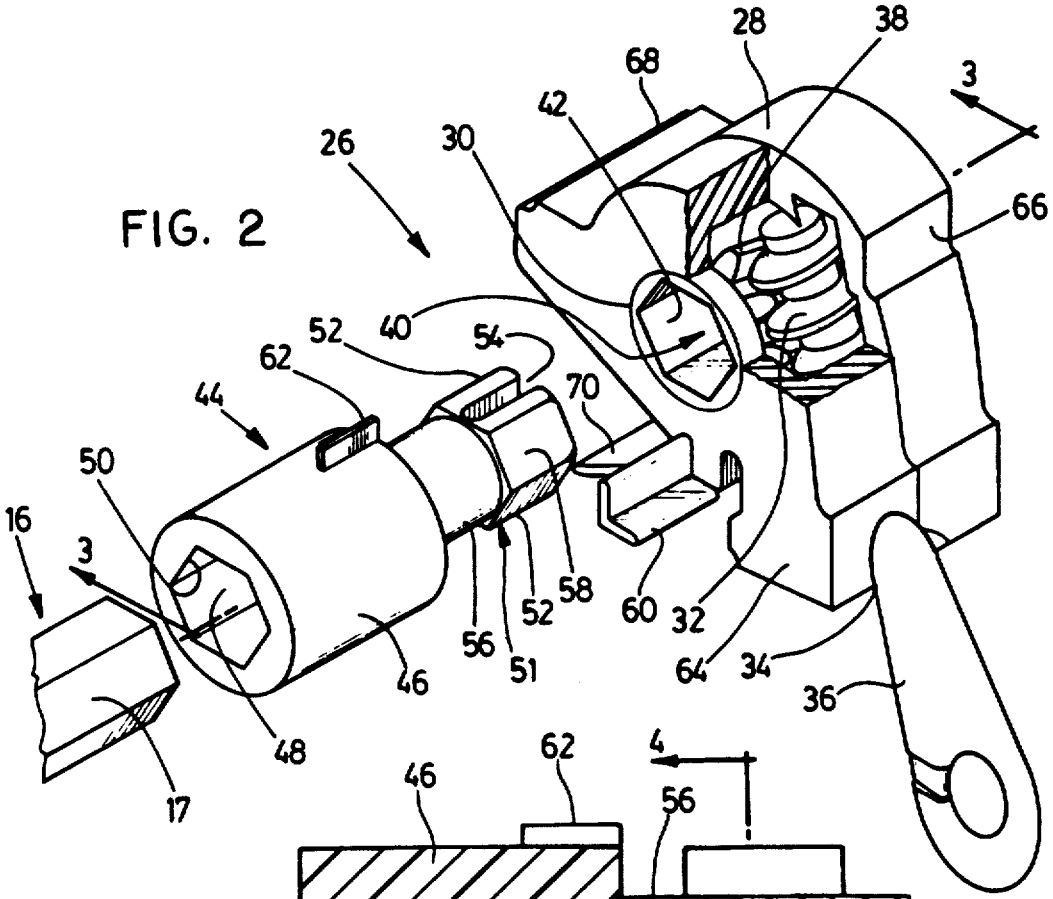
FIG. 2 is an exploded perspective view partially cut away of the transmission mechanism of FIG. 1.

Referring first of all to FIGS. 1 and 1A, it will be noted that the invention is shown there used in association with a venetian blind assembly of the type having a headrail indicated generally as 10, having a bottom wall 12, and side walls 14 and 15 in turn having their upper edges folded over inwardly to provide top edge retaining means on lips 14*a* and 15*a* respectively. A shaft 16 having a hexagonal cross-sectional configuration extends along the interior of the headrail 10, being supported by bearings 18. The individual surfaces of the shaft 16 are indicated by the legend 17.

The head rail 10 is preferably closed at each end by closure 10*a*.

A plurality of blind slats 20 are supported on tilt tapes or cords 22, in a manner known per se.

The cords or tapes 22 extend upwardly through the bottom wall 12 of the headrail 10, and are wound around a sleeve 24 keyed to the shaft 16.

In addition, as in other venetian blinds, further raise cords C are provided extending centrally through the slats 20, by means of which the slats 20 may be raised or lowered. Those raise cords C and the cord-locking mechanism L (FIG. 1A) associated therewith are known per se, and detailed illustrations are omitted for the sake of clarity.

As illustrated in FIG. 1, the bearing 18 will be seen to comprise first and second bearing portions 18*a* and 18*b*, of integral one piece construction, typically being formed of moulded thermo-plastic material. Bearing portion 18*a* is formed with a generally upwardly open U-shaped recess 19*a*, and bearing portion 18*b* is formed with a bearing in the form of through-opening 19*b*, bearing portion 18*b* having a bridge portion 18*c* extending thereover, whereby to prevent the escape of the rod 16 thereform.

The bearing 18 is retained in position, within the headrail 15, by means of shoulders 18*d*, engaging the top edge lips 14*a* and 15*a* of the headrail.

As explained above (and illustrated in FIG. 1A), there will (usually) be more than one bearing 18. The bearings 18 also provide for the passage of the tilt cords 22, and the raise cords C, in a manner which will be readily understood, but which is omitted for the sake of clarity.

Figure 10:
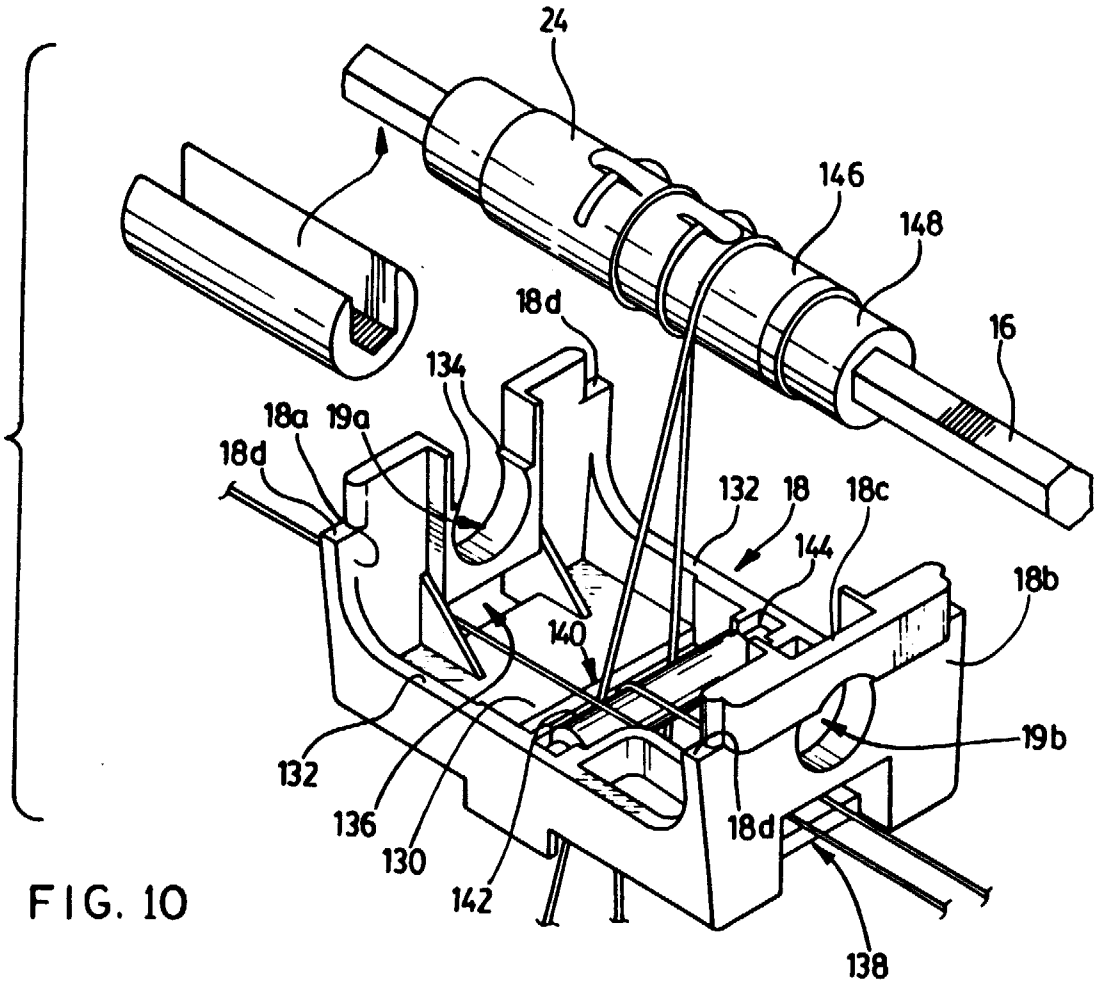
FIG. 10 is an exploded perspective illustration of a bearing assembly and the tilt rod of the venetian blind assembly of FIG. 1A.

Detailed illustration of a preferred form of bearing assembly is shown in FIG. 10.

It will, of course, be appreciated that as in all venetian blinds, two pairs of the tilt cords 22 (FIG. 1A) are provided at spaced intervals along the headrail 10, for supporting the slats 20 at two spaced-apart positions. However, only one such pair of cords 22 is shown (in FIG. 1) for the sake of clarity.

The transmission mechanism in accordance with the invention is indicated generally as 26. Transmission mechanism 26 is provided to control the angle of tilt of the slats 20. The angle of tilt is controlled or adjusted, by simply rotating the shaft 16 either clockwise or anti-clockwise.

Figure 3:
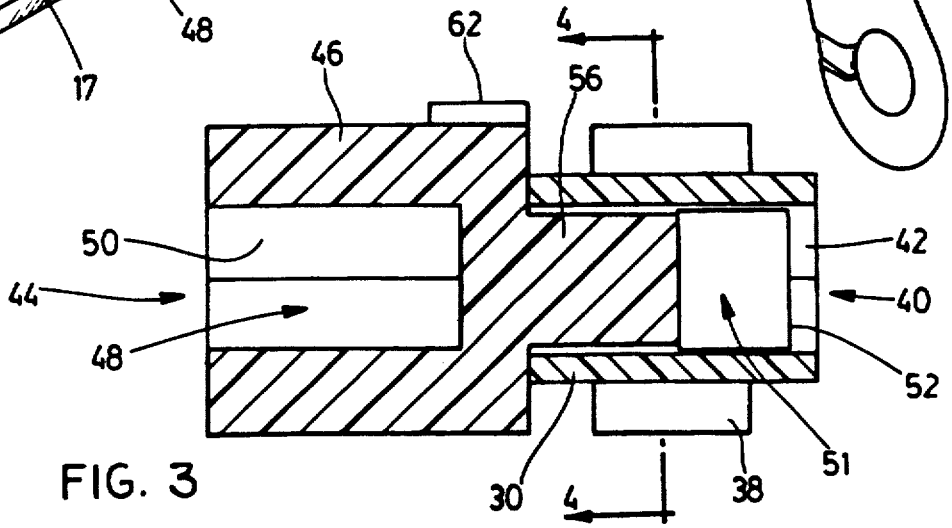
FIG. 3 is an axial sectional view when taken as indicated by the arrows 3—3 of FIG. 2 with the component parts in their assembled positions.
Figure 4:
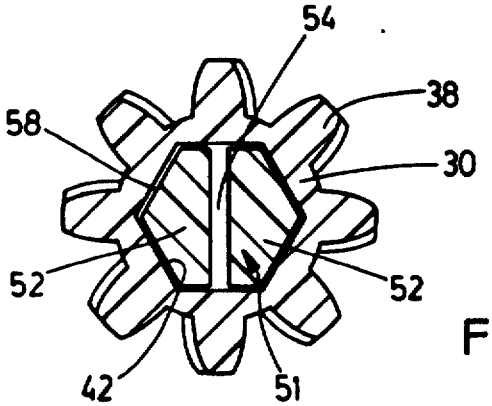
FIG. 4 is a transverse section when taken as indicated by the arrows 4—4 of FIG. 3.

The transmission mechanism 26 is shown in more detail in FIGS. 2, 3, and 4. It will be seen to comprise a housing 28, housing a drive member or gear 30, and a worm drive gear 32.

Worm drive gear 32 is, in turn, mounted on a shaft 34, which is formed at its free end with a wand connection 36. The wand is omitted from the drawing for the sake of clarity.

Drive gear 30 is formed with a plurality of exterior teeth 38 adapted to be engaged by the worm drive gear 32.

An interior recess 40 is formed as a through-bore through drive gear 30 along its central axis and drive surfaces 42 are formed inside recess 40 of regular shape along the length of the through-bore or recess 40 for reasons yet to be described.

In order to couple the drive gear 30 to the shaft 16, a torque-limiting coupling generally indicated at 44 is provided. Coupling 44 comprises a generally cylindrical body portion 46 having an interior axial recess 48. Drive surfaces 50 are formed within recess 48 for receiving an end of the shaft 16, the surfaces 17 of the shaft 16 being complementary to the drive surfaces 50 whereby the shaft 16 may be drivingly received in the recess.

Coupling 44 further comprises a generally U-shaped end member generally indicated at 51 and including a pair of arms 52. The arms 52 are separated by a slot 54. They are preferably formed of thermoplastic material and are, to some degree, resilient such that they may be flexed toward each other and will, when released, spring apart from one another.

Arms 52 are connected to the body portion 46 through a reduced diameter neck portion 56. Arms 52 and define a plurality of drive surfaces 58. Surfaces 58 are complementary to surfaces 42 in the recess 40 of drive gear 30.

Rotation of gear 30 will thus be transmitted through the drive surfaces 42, and 58 to the coupling 44 and through drive surfaces 48, and 51 to the shaft 16.

It is necessary that means shall be provided to limit rotation of the tilt shaft 16 in both directions, in turn to restrict the tilting of the slats 20 in both directions.

In this particular embodiment, abutment members 60 are formed on each side of the housing 28 and a stop member or flange 62 is formed on the cylindrical body 46 of the coupling 44. In this way, rotation of the coupling will be limited by contact of the stop flange 62 with one of the abutment members 60 regardless of the direction of rotation.

Two abutment members 60 are provided, one on each side of the housing 28 to permit the housing 28 to be used at either end of the headrail 10.

Referring again to FIGS. 1 and 2, it will be noted that the housing 28 is formed with a downwardly dependent boss or leg 64 which extends through aligned openings in the bottom wall 12 and the front side wall 14 of the headrail 10. A recess 66 (FIG. 2) is provided in the housing 28 to receive top edge lip 14*a* of the side wall 14.

The housing 28 is also formed with an outward projection 68 (FIG. 2) which, when the housing 28 is in position in the headrail 10, is received under the top edge lip 15*a* as will readily be understood by reference to a resilient tongue 70 also integrally formed with the housing 28 presses against the bottom wall 12 to ensure a snug non-rotatable fit of the transmission mechanism 26 in the headrail 10.

In normal operation, the wand (not shown) rotates the shaft 34 connector 36 which, in turn, through the coupling 44 rotates the shaft 16, until the desired angle of tilt for the slats 20 has been achieved. Once the stop flange 62 has contacted an abutment member 60, no further rotation of the shaft 16 can take place. However, in the event that excessive torque is applied to the drive gear 30, after the stop flange 62 has contacted the abutment member 60, by, for example, someone continuing to rotate the wand, or by some other misuse, then the arms 52 will flex toward each other, disengaging the driven surfaces 58 of the arms 52 from the drive surfaces 42 of the gear 30. The gear 30 will thus rotate, while the coupling 44 will remain stationary.

It will thus be noted that a simple yet highly effective form of torque-limiting coupling device or transmission mechanism, is provided, and that a simple straight-forward coupling is provided in a manner which makes it economical to manufacture and assemble.

Figure 5:
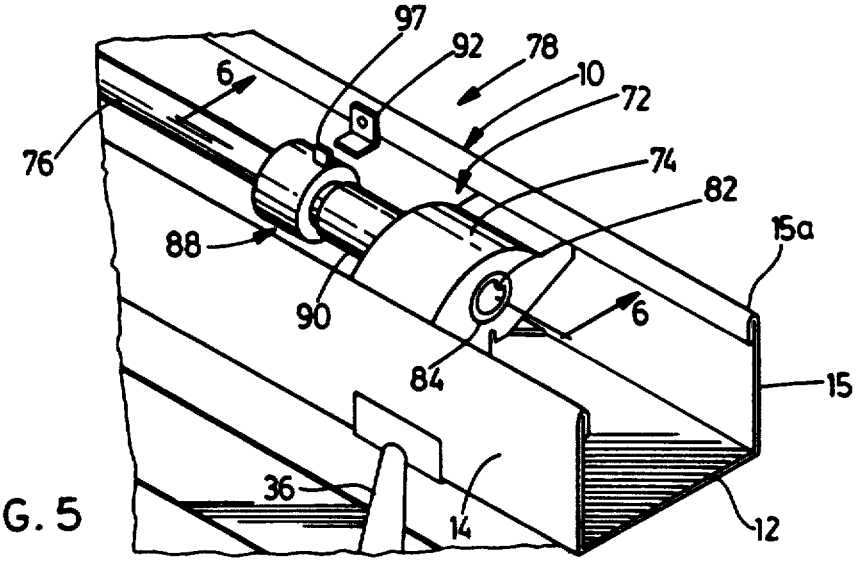
FIG. 5 is a perspective illustration similar to that of FIG. 1 but showing an alternative embodiment of the invention.
Figure 6:
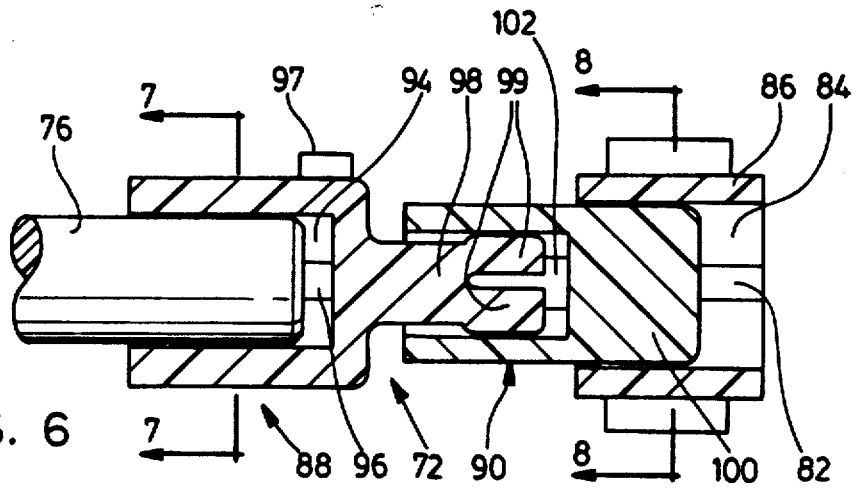
FIG. 6 is an axial sectional view through the transmission mechanism of FIG. 5 when taken as indicated by the arrows 6—6 of that figure.
Figure 8:
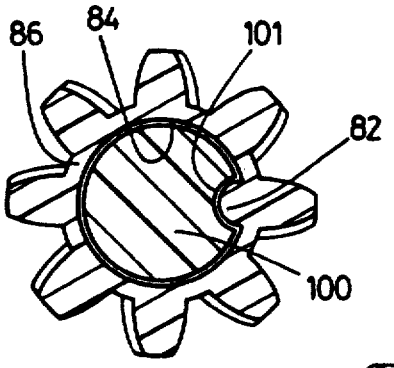
FIG. 8 is a section along the line 8—8 of FIG. 6.
Figure 7:
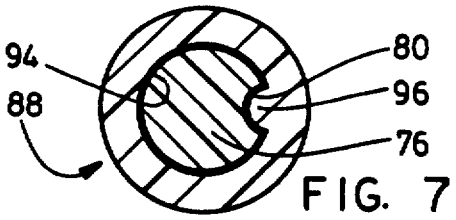
FIG. 7 is a transverse section when taken as indicated by the arrows 7—7 of FIG. 6.

Reference will next be made to FIGS. 5, 6 and 7 of the accompanying drawings in which there is indicated generally at 72 a transmission mechanism including a housing 74 for driving a shaft 76 of a blind assembly generally indicated at 78.

The blind assembly 78 is almost identical to the blind assembly 10 hereinbefore described, but differs therefrom in that the shaft 76 is generally cylindrical. Shaft 76 has a longitudinally extending semi-cylindrical recess or notch 80 (FIG. 7) which would normally engage a correspondingly shaped semi-cylindrical key 82 formed in an axial recess 84 of a drive gear 86 corresponding to the drive gear 30 of the mechanism already described.

To permit the use of a torque limiting coupling similar to the coupling 44 already described in this modified form of blind assembly, the transmission mechanism utilizes a modified torque-limiting coupling 88 and an adaptor 90.

Additionally, a separate abutment member 92 (FIG. 5) is provided for reasons to be described below. Such an abutment member is adapted to be secured in any convenient manner to the side wall 15 of the headrail 10.

The coupling 88 is provided, at one end, with a cylindrical axial recess 94 having a semi-cylindrical key 96 for engagement with the notch 80 in the shaft 76. It will now be understood that the recess 94 has the same transverse sectional configuration and key and dimensions as the recess 84 in the drive gear 86.

The coupling 88 comprises, at its opposite end, an axial extension 98 having arms 99 defining an hexagonal cross-sectional configuration corresponding to that of the coupling 44. Coupling 88 also has a stop member 97 formed thereon.

The adaptor 90 comprises, at one end, an axial extension 100 having a transverse sectional configuration and notch 101 identical in shape to that of the shaft 76 (FIG. 7). This extension 100 is received in the axial recess 84 of the drive gear 86 so that rotation of that drive gear 86 will cause rotation of the adaptor 90.

At its opposite end, the adaptor 90 is formed with an axial recess 102 having a hexagonal transverse sectional configuration identical in shape to that of the recess 40 provided in the drive gear 30 of the mechanism already described with reference to FIGS. 1 to 4 of the drawings.

The U-shaped arms 99 of the coupling 88 are received in the recess 102 for conjoint rotation of the coupling 88 and the adaptor 90 until such time as the stop member 97 engages the abutment member 92. After such engagement, if rotation of the drive gear 86 is continued, the arms 99 of the coupling 88 will flex toward each other so permitting the adaptor 90 to continue to rotate while the coupling 88 and the shaft 76 remain stationary.

It will now be understood that the use of the coupling 88 and adaptor 90 permits the use of the invention in a blind assembly in which the configuration of the shaft 76 and the axial recess 84 in the drive gear 86 are different from the configurations of the recess 48 and the U-shaped end member 51 of the coupling 44.

It will also be understood that the coupling 88 and adaptor 90 will not be required if the shaft 76 is identical to the shaft 16 having a hexagonal cross-sectional configuration and is used with an existing housing and a drive gear with a correspondingly configured axial recess. In such a situation, it will simply be necessary to attach an abutment member 92 at an appropriate position on the side wall 15.

Figure 9:
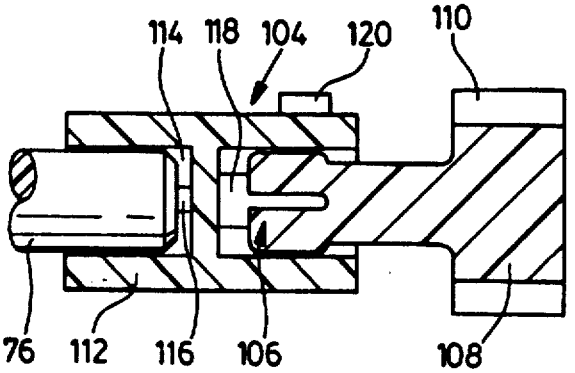
FIG. 9 is an axial sectional view through yet another embodiment of a transmission mechanism in accordance with this invention.
Figure 11:
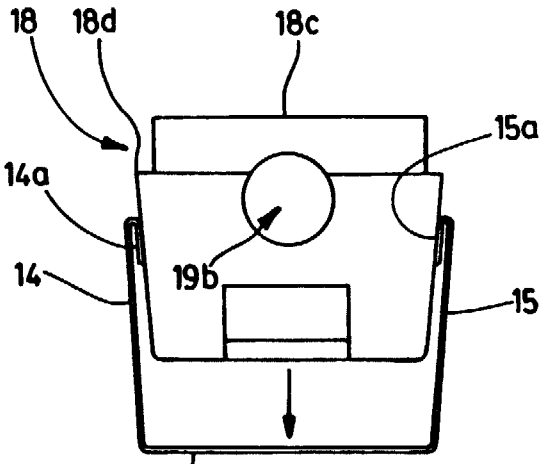
FIG. 11 is a section along the line 11—11 of FIG. 1A showing the insertion of a bearing assembly into the blind track, and, FIG. 12 is an exploded perspective illustration of one end of the venetian blind assembly of FIG. 1A.
Figure 12:
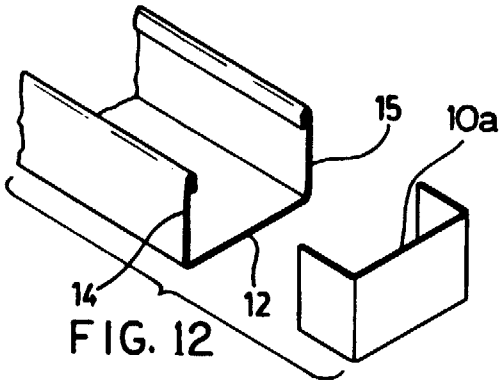

Referring now to FIG. 9 of the accompanying drawings in which there is shown generally at 104 part of yet another embodiment of a transmission mechanism in accordance with this invention. The mechanism 104 is shown as being used for driving a shaft 76 identical to shaft 76 already described. In this particular embodiment, resilient arm means generally indicated at 106 are integrally formed with a drive gear 108 having teeth 110. Since the arm means are identical to that already described with reference to FIGS. 1 to 4, the component parts will not be separately identified.

The mechanism 104 also comprises a coupling generally indicated at 112 including, at one end, an essentially cylindrical axial recess 114 is provided with a semi-cylindrical key 116 and is adapted to receive the end of the shaft 76 for co-rotation therewith (as described in the embodiment of FIGS. 5-8. At its opposite end, the coupling 112 is formed with an axial recess 118 having a hexagonal transverse sectional configuration as already described in connection with FIGS. 1-4.

A stop member 120 is integrally formed with the coupling 112 and projects radially outwardly therefrom.

It is believed that the manner of operation of the transmission mechanism 104 shown in FIG. 9 will easily be understood by comparison with that of the preceding figures and that, therefore, no further description need be provided herein.

It will of course be appreciated that while the embodiment of FIG. 9 is illustrated in association with a cylindrical shaft 76, and acircular recess 114 having a rib 116, this is by way merely an example. This embodiment of the invention will equally be applicable to a shaft having a hexagonal or other cross section, and the recess 114 would then of course be modified to suit.

A preferred form of bearing assembly 18 will now be described in more detail in connection with FIG. 10.

As already explained in relation to FIG. 1 and 1A, the bearing assembly 18 is of integral one piece thermoplastic construction. The two walls 18A and 18B are joined by a junction wall 130 having side channel walls 132 on either side therefore for greater strength.

In the embodiment of FIG. 10 the U-shaped recess in wall 18A is preferably provided with inturned abutment portions 134 on either side, so as to enclose slightly more than a 180 deg. of arc.

The through-opening in wall **18*b*** is formed with a bridge formation already described extending completely thereacross and thereby providing a entirely enclosed through-opening for retention of the shaft therein.

In order to provide for passage of the cords and tapes and the like, openings 136 and 138 are formed in walls **18*a* and 18*b*. In order for downward guidance of those cords or tapes extending downwardly from the bearing assembly 18, a downwardly open slot 140 is formed in junction portion 130. Adjacent slot 140, a roller bearing 142 is supported in end channel support 144, located on respective side walls 132**.

The sleeve indicated as 24 in FIGS. 1 and 1A comprises a generally cylindrical metallic tube having tongues 146 adapted to be crimped over the ends of the tapes or cords as shown.

The sleeve 146 is in turn mounted on a bearing sleeve body 148 formed of thermoplastic material. Body 148 is formed with a through-bore having formations adapted to conform to the shape of the particular drive shaft 16 in the particular drape or blind assembly.

The bearing sleeve 148 defines free ends extending from either end of the metallic sleeve 146. The bearing sleeve 148 thus provides bushings for retention in the bearing walls 18A and 18B, and thus provides for an extended working life of the drape or blind assembly.

In order to prevent endwise movement of the shaft 16, relative to the headrail, a stop sleeve 150 is provided. Sleeve 150 is formed of thermoplastic material. In this embodiment it has a generally partially cylindrical exterior, and is formed with an axial slot 152, shaped and adapted to conform to the shape of the shaft 16. It is sized and adapted to make a tight friction fit on the shaft 16.

Once in position as shown in FIG. 1A, the sleeve 150 will effectively prevent axial movement of the shaft relative to the drive assembly 28. This will ensure that the shaft does not inadvertently become disengaged from the drive assembly 28, or from the coupling 44.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A drape or blind assembly comprising:

a headrail having drapes or blind slats suspended therefrom;

a shaft disposed in said headrail on rotation of which the positions of the drapes or blind slats may be adjusted said shaft having a predetermined cross-sectional shape defined driven formations;

a transmission mechanism which in turn comprises:

drive means disposed in said headrail;

a coupling coupled to said drive means for transmitting rotational movement of said drive means to said shaft;

a drive recess defined by said coupling having drive formations complementary to said shaft, for receiving said shaft;

a stop member on said coupling;

an abutment member adapted to engage said stop member on rotation of said coupling to a predetermined rotational position thereby then to prevent rotation of said coupling beyond said predetermined position;

a recess in said drive means defining a through-bore of regular cross-section and having internal first drive surfaces of predetermined cross-sectional shape and, resilient arm means on said coupling slideable into and out of said through-bore and adapted to be received therein and having second drive surfaces complementary to said first drive surfaces and being resiliently biassed to engage said first drive surfaces to transmit rotational movement therebetween for rotation of said shaft and whereby, upon rotation of said coupling to said predetermined rotational position and engagement of said stop member with said abutment member further rotation of said coupling and said shaft is halted, and, if excessive torque is then applied by continued rotation of said drive means, said resilient arm means will flex against said biassing thereby in turn permitting said drive means to continue to rotate.

2. A drape or blind assembly as claimed in claim 1 and in which said resilient arm means comprises a pair of mutually spaced apart arms extending from one end of said coupling in an axial direction, into said recess in said drive means.

3. A drape or blind assembly as claimed in claim 2 and in which said stop member is integrally formed with said coupling to project therefrom.

4. A drape or blind assembly as claimed in claim 3 wherein said transmission mechanism includes a housing and in which said abutment member is integrally formed with said housing to project therefrom.

5. A drape or blind assembly as claimed in claim 3 and in which said abutment member is a separate component adapted to be secured to the headrail of such a drape or blind assembly.

6. A drape or blind assembly as claimed in claim 3 and wherein said drive means comprises a worm drive gear carried by a worm drive shaft rotatably supported in a drive housing, said worm drive gear engaging a driven gear coupled to said coupling whereby rotation of said worm drive gear causes rotation of said coupling.

7. A drape or blind assembly as claimed in claim 6, in which said housing comprises a boss portion adapted to extend through an opening in said headrail and in which said worm drive shaft extends through said boss portion and is adapted to be coupled to a drive wand.

8. A drape or blind assembly as claimed in claim 1 and which additionally comprises an adaptor coupled to said drive means for co-rotation and defines an acircular recess defined in said adaptor complementary to said resilient arm means, and an acircular axial extension of said adaptor being received in said recess in said drive means.

9. A drape or blind assembly as claimed in claim 8 and in which said recess in said drive means has a different configuration than said acircular recess in said adaptor.

10. A drape or blind assembly comprising:

a headrail having drapes or blind slats suspended therefrom;

a shaft disposed in said headrail on rotation of which the positions of the drapes or blind slats may be adjusted said shaft having a predetermined cross-sectional shape defining driven formations;

a transmission mechanism which in turn comprises;

a drive means disposed in said headrail;

a coupling defining two ends and coupled to said drive means for transmitting rotational movement of said drive means to said shaft;

a driven recess at one end of said coupling, said driven recess defining driven surface formations therein;

a drive means at said other end of said coupling having drive formations complementary to said shape of said shaft, for receiving said shaft;

a stop member on said coupling;

an abutment member adapted to engage said stop member on rotation of said coupling to a predetermined rotational position thereby then to prevent further rotation of said coupling;

resilient arm means extending from said drive means defining drive surfaces of predetermined cross-sectional shape and being slideable into and out of said driven recess of said coupling and adapted to be received therein and being resiliently biassed to engage said driven surface formations to transmit rotational movement therebetween for rotation of said shaft and whereby upon rotation of said coupling to said predetermined rotational position and engagement of said stop member with said abutment member further rotation of said coupling and said shaft is halted, and, it excessive torque is then applied by continued rotation of said drive means, said resilient arm means will flex against said biassing thereby in turn permitting said drive means to continue to rotate.

11. A drape or blind assembly as claimed in claim 1, and including integral bearing means received in said headrail and spaced from said transmission means, said bearing means in turn comprising:

first and second bearing walls;

a generally upwardly open U-shaped recess in said first bearing wall;

a thorough-opening through said second bearing wall, and, bridge means extending over said opening in said second bearing wall, whereby said shaft may lie in said U-shaped recess in said first bearing wall, and may extend through said opening in said second bearing wall and be retained therein by said bridge means.

12. A blind or drape assembly as claimed in claim 11, and wherein said headrail defines a generally upwardly open U-shaped channel shape in section, and including lip means on opposed edges of said channel and wherein said bearing means is retained in position therein by inter-engagement with said lip means.

13. A drape or blind assembly as claimed in claim 12 including shoulder means formed on said first and second bearing walls, said shoulder means being inter-engaged with said lip means for retention of said bearing means in said headrail.

14. A drape or blind assembly as claimed in claim 13, and wherein said generally upwardly open U-shaped recess in said first bearing wall, is formed with abutment means, enclosing more than 180 degrees of arc and including bushing sleeve means on said shaft, said bushing sleeve means defining a predetermined cylindrical shape and predetermined diameter adapted to make a snap fit within said abutment means of said upwardly open U-shaped recess, and to make a good rotational fit in said through opening in said second bearing wall.

15. A drape or blind assembly as claimed in claim 14, and further including a junction wall extending between said first and second bearing walls, side edge walls along either side of said junction wall, and downwardly open opening means in said junction wall for passage of blind control means therethrough.

16. A drape or blind assembly as claimed in claim 15 and further including antifriction guide means mounted between said side walls adjacent to said downwardly open opening means, for guiding said blind control means therethrough.

17. A drape or blind assembly as claimed in claim 16 wherein said antifriction means comprises at least one roller member extending from side wall to the other, and including a roller retention means for rotatably supporting said roller means.

18. A drape or blind assembly as claimed in claim 12 wherein said first and second bearing walls define wall edges on opposite sides thereof, and wherein said wall edges are formed in a generally tapered manner, whereby to provide a wedging fit in said headrail, whereby when said bearing assembly is pressed downwardly into said headrail, said side edges of said first and second bearing walls progressively wedge said side walls of said head rail further apart from one another.

19. A drape or blind assembly as claimed in claim 18 including shoulder means formed on said side edges of said first and second bearing walls adapted to inter-engage with said lip means on opposed edges of said channel, and to lock the same in position.

20. A drape or blind assembly comprising:

a head rail having drapes or blind slats suspended therefrom;

a shaft disposed in said head rail on rotation of which the positions of the drapes or blind slats may be adjusted said shaft having a predetermined cross-sectional shape defining driven formations;

a transmission mechanism which in turn comprises:

drive means disposed in said head rail;

a coupling coupled to said drive means for transmitting rotational movement of said drive means to said shaft;

a drive means defined by said coupling having drive formations complementary to said shaft, for receiving said shaft;

a stop member on said coupling;

an abutment member adapted to engage said stop member on rotation of said coupling to a predetermined rotational position thereby then to prevent further rotation of said coupling;

a recess in said drive means defining a through-bore of regular cross-section and having internal drive surfaces of predetermined cross-sectional shape and, a resilient arm means on said coupling slideable into and out of said through-bore and adapted to be received therein and having second drive surfaces complementary to said first drive surfaces and being resiliently biassed to engage said first drive surfaces to transmit rotational movement therebetween for rotation of said shaft and whereby, upon rotation of said coupling to said predetermined rotational position and engagement of said stop member with said abutment member further rotation of said coupling and said shaft is halted, and, if excessive torque is then applied by continued rotation of said drive means, said resilient arm means will flex against said biassing thereby in turn permitting said drive means to continue to rotate;

an adaptor coupled to said drive means for co-rotation therewith and defines an acircular recess complementary to said resilient arm means, and, an acircular axial extension of said adaptor being received in said recess in said drive means, 21. A drape or blind assembly as claimed in claim 20 and in which said recess in said drive means has a different configuration than said axial recess in said adaptor.

* * * * *